US007632169B2

(12) United States Patent
Fujita

(10) Patent No.: US 7,632,169 B2
(45) Date of Patent: Dec. 15, 2009

(54) POLISHING METHOD AND POLISHING APPARATUS

(75) Inventor: Takashi Fujita, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 11/807,069

(22) Filed: May 25, 2007

(65) Prior Publication Data

US 2008/0070488 A1 Mar. 20, 2008

(30) Foreign Application Priority Data

Sep. 15, 2006 (JP) ..... 2006-251785

(51) Int. Cl.
*B24B 1/00* (2006.01)

(52) U.S. Cl. ..... 451/41; 451/60; 451/287; 451/446

(58) Field of Classification Search ..... 451/36, 451/41, 59, 60, 285, 287, 446
See application file for complete search history.

(56) References Cited

U.S. PATENT DOCUMENTS

| | | | | |
|---|---|---|---|---|
| 5,308,438 | A * | 5/1994 | Cote et al. | 216/86 |
| 5,709,593 | A * | 1/1998 | Guthrie et al. | 451/287 |
| 5,916,010 | A * | 6/1999 | Varian et al. | 451/38 |
| 5,928,062 | A * | 7/1999 | Miller et al. | 451/41 |
| 6,139,406 | A * | 10/2000 | Kennedy et al. | 451/67 |
| 6,371,836 | B1 * | 4/2002 | Brown et al. | 451/56 |
| 6,375,791 | B1 * | 4/2002 | Chiesl et al. | 156/345.13 |
| 6,685,796 | B1 * | 2/2004 | Lin et al. | 156/345.1 |
| 6,863,770 | B2 * | 3/2005 | Jae et al. | 156/345.12 |
| 6,887,132 | B2 * | 5/2005 | Kajiwara et al. | 451/41 |
| 2004/0121710 | A1 * | 6/2004 | Boyd | 451/56 |
| 2006/0105678 | A1 * | 5/2006 | Kohama et al. | 451/5 |
| 2007/0087672 | A1 * | 4/2007 | Benner | 451/56 |

FOREIGN PATENT DOCUMENTS

| | | |
|---|---|---|
| JP | 2004-063888 | 2/2004 |
| JP | 2005-177934 | 7/2005 |

* cited by examiner

*Primary Examiner*—Eileen P. Morgan
(74) *Attorney, Agent, or Firm*—Fattibene and Fattibene; Paul A. Fattibene

(57) ABSTRACT

An object of the present invention is to provide a polishing method and a polishing apparatus that can secure an even polished shape and can remove slurry that has contributed to polishing and contains polishing by-product to the outside of a pad efficiently to reduce scratches due to the polishing by-product, and can suppress consumption of slurry to the minimum to realize cost reduction during running for mass production.

In order to achieve the above object, the present invention provides a polishing method where a mechanism that suspends a member 15*a* on a pad 19 surface to bring the member in contact with or cause the member to approach the pad 19 surface and supplies the slurry along the member 15*a* to apply the slurry to the pad 19 surface is provided, a surface of the pad 19 applied for polishing has a plurality of grooves communicating from a central portion of a surface portion of the pad to an edge portion thereof, and a step of supplying pure water along the respective grooves during a polishing processing to remove polishing by-product from the edge portion to the outside of the pad 19 is provided.

13 Claims, 13 Drawing Sheets

POLISHING METHOD AND POLISHING APPARATUS

TECHNICAL FIELD

The present invention relates to a polishing method and a polishing apparatus, and in particular to a polishing method and a polishing apparatus in chemical mechanical polishing (CMP).

BACKGROUND ART

A wafer for a semiconductor device, an electronic part, or the like is subjected to various steps such as cutting or polishing in the course of manufacture. In recent years, according to development of a semiconductor technique, miniaturization and multilayer wiring of design rule of a semiconductor integrated circuit advance, and a diameter enlargement of a wafer also progress for achieving cost reduction. Therefore, when a layer formed with a pattern is formed thereon with a pattern of the next layer like the conventional art as it is, it becomes difficult to form an excellent pattern on the next layer due to undulation of the precedent layer and a defect or the like may occur easily.

Therefore, a planarizing process for planarizing a surface of a layer formed with a pattern and subsequently forming a pattern of the next layer is implemented. CMP is frequently used in the planarizing process. Polishing of a wafer utilizing CMP is performed by holding the wafer by a polishing head, pressing the wafer to a rotating polishing pad, with a predetermined pressure, and supplying slurry that is mixture of abrading agent and chemicals between the polishing pad and the wafer.

In the polishing utilizing CMP, the slurry supplied on the polishing pad is an important factor influencing a polished shape of a wafer. In order to polish a wafer evenly, it is necessary to supply the slurry to the polishing pad evenly.

When the slurry is supplied to the polishing pad surface excessively, the polishing cost increases in mass production, so that it is also necessary to supply slurry onto the polishing pad in small amounts efficiently and evenly.

A groove is generally formed on a surface of a polishing pad. The groove is generally for distributing slurry to the whole surface of the polishing pad, and, for example, it is conventionally known that a plurality of grooves are formed radially and depths of the respective grooves at an outer peripheral portion of the polishing pad are made shallow in order to perform distribution of slurry to the polishing pad surface efficiently (for example, see Patent Document 1).

However, slurry only when it is conveyed to a surface portion of the polishing pad contributes to polishing to a wafer instead of supplying of the slurry into the grooves. Therefore, how to supply slurry to the surface portion of whole polishing pad efficiently is important.

On the other hand, for example, a slurry supplying apparatus that introduces slurry onto a polishing pad through a slurry transport pipe, a wafer polishing apparatus that can change a slurry supplying position using a movable arm, or a polishing apparatus provided with a squeegee that sprays slurry in a mist and spreads the slurry on a polishing face, or the like is known (for example, see Patent Document 2, 3, or 4).

[Patent Document 1] JP-A-2005-177934 (Page 4 and FIG. 1)

[Patent Document 2] JP-A-2004-63888 (Page 4 and FIG. 3)

[Patent Document 3] JP-A-11-70464 (Page 4 and FIG. 2)

[Patent Document 4] JP-A-10-296618 (Page 4 and FIG. 9)

DISCLOSURE OF THE INVENTION

In a conventional art described in Patent Document 1, a groove constitution is proposed for achieving both of that slurry is distributed to the whole polishing pad rapidly and that a large amount of slurry is retained in the grooves on the polishing pad. However, when the radial grooves are provided on the polishing pad, slurry on the polishing pad is easily exhausted outside according to rotation of the polishing pad. Therefore, it is necessary to supply a large amount of slurry freshly, so that large amount of slurry must be provided. As a result, such a problem still occurs that cost of slurry becomes high.

In the conventional arts described in Patent Documents 2 to 4, slurry is spread between a wafer and a polishing pad or between the polishing pad and a squeegee in a pressing manner to be distributed and supplied to a whole surface of the polishing pad. In such a supplying method, slurry is supplied via grooves formed on the polishing pad, so that a spreading way of slurry changes due to the number of rotations of the polishing pad, a pressure between the polishing pad and a wafer, an arrangement of grooves, or the like. Therefore, it is difficult to evenly supply slurry to the whole surface of the polishing pad securely.

When slurry spreads on the whole surface of the polishing pad, such a case occurs that a portion of slurry in the grooves on the polishing pad contributes to polishing, but another portion thereof does not contribute to polishing and it is exhausted from the polishing pad to the outside as it is, which results in wasteful consumption of slurry.

When polishing by-product including grinding sludge and pad dusts that has been generated due to polishing is exhausted from the grooves on the polishing pad to the outside, the polishing by-product is mixed into fresh slurry, so that scratches are generated on the wafer by the mixed polishing by-product. Such a problem can be reduced by supplying a large amount of slurry, but the amount of slurry used increases considerably, which results in much increase in cost.

Besides, in the polishing of wafer using CMP, it is inevitable to perform dressing of the polishing pad periodically in order to prevent lowering of the polishing rate due to clogging of the polishing pad. In the dressing of the polishing pad, a surface of the polishing pad is roughened and polished while the surface is being shaved. The shaving amount of the polishing pad is in a range of about 0.2 to 0.5 μm per one polishing, but the polishing pad surface is shaved up to about 200 to 500 μm while about 1000 wafers are polished. At this time, the grooves are not shaved. Since depths of the groove are about 700 μm at most, the grooves are deep in an initial stage of polishing pad use, but such a case occurs in a final stage of polishing pad use that sectional areas of the grooves are reduced by half. Thereby, a difference occurs in spreading of slurry between the initial stage of use of the polishing pad and a stage thereof after a long period use, which influences a polishing quality of a wafer.

As described above, in the polishing of a wafer using CMP, slurry that has contributed to polishing and polishing by-product are generated necessarily after a fixed polishing termination. After the polishing by-product has contributed to polishing, it drops in the grooves on the polishing pad. The polishing by-product that has dropped in the grooves of the polishing pad is exhausted outside the polishing pad only through the grooves.

Since the polishing by-product continuing to remain on the surface of the polishing pad causes occurrence of scratches or the like, it is desirable that the polishing by-product drops in the grooves and the slurry that has dropped in the grooves is exhausted without riding on the surface of the polishing pad again.

However, in the conventional art described in the respective Patent Documents describing supplying of fresh slurry via the grooves, the polishing by-product that has dropped in the grooves is mixed to slurry supplied newly. With such a constitution that the newly supplied slurry is distributed through the grooves and it is retained in the polishing pad, it overflows from the grooves to be supplied to the polishing pad surface.

In this case, when the newly supplied slurry is supplied to the surface of the polishing pad, also the polishing by-product that has dropped in the grooves on the polishing pad is supplied thereto again. Agglomerated material or the like damaging a surface of a wafer is contained in the polishing by-product and it acts on the wafer surface again, so that the wafer surface is scratched.

Such a mechanism that even the polishing by-product that has already contributed to polishing is supplied to the polishing pad surface again occurs in principle, a factor causing scratches essentially remains on the polishing pad surface indefinitely. Since slurring partially mixed with the used slurry including the polishing by-product is always supplied at the polishing rate to the polishing pad surface, there is such a possibility that chemical characteristic inherent in the slurry cannot be derived to the maximum necessarily.

When an exclusion performance of polishing by-product is elevated, a retaining performance of slurry on the polishing pad lowers so that fresh slurry must be sequentially supplied to the polishing pad, which results in increase in consumption amount of slurry and increase in cost.

On the contrary, when such a groove constitution that slurry is held on the polishing pad is adopted, the polishing by-product that has dropped in the grooves together with fresh slurry is returned back to the polishing pad surface again. Therefore, formation of scratches on a surface of a wafer is caused, so that stable scratch-free polishing cannot be achieved. Accordingly, it is difficult in principle to secure two functions of holding distribution performance of slurry and exclusion of polishing by-product utilizing the grooves on the polishing pad.

In view of these circumstances, a technical problem to be solved is raised for securing even polished shape and removing slurry that has contributed to polishing and contains polishing by-product outside the pad efficiently to reduce scratches due to the polishing by-product, and suppressing consumption of slurry to the minimum to realize low cost during running for mass production, and an object of the present invention is to solve the problem.

SUMMARY OF THE INVENTION

The present invention has been proposed for achieving the object, and the invention in one embodiment provides a polishing method where a polishing face is supplied with slurry and polishing is performed by relative movement between the polishing face and a wafer, wherein a mechanism that suspends a member on a pad surface to bring the member in contact with or cause the member to approach the pad surface and supplies the slurry along the member to apply the slurry to the pad surface is provided, a surface of the pad applied for polishing has a plurality of grooves communicating from a central portion of a surface portion of the pad to an edge portion thereof, slurry is supplied while the slurry is being applied to the pad surface, and slurry that has contributed to polishing is dropped in the grooves of the pad to be exhausted.

According to the constitution, a distal end of the member is disposed so as to contact with or approach the pad surface, supplying of slurry to a polishing face on the pad is performed by flowing the slurry down along the member. Even if the slurry that has flowed down is small in quantity, it spreads evenly on the polishing face due to interfacial tension acting between the polishing face of the pad and the member, and it is supplied to the polishing face of the pad evenly and thinly due to relative movement between the member and the pad. Thus, fresh slurry is constantly supplied to the polishing face of the pad via the member. A wafer is polished on the polishing face on which fresh slurry is constantly supplied evenly and thinly by relative movement between the wafer and the pad. The slurry that has contributed to the polishing is caused to drop in the plurality of grooves according to the relative movement between the wafer and the polishing face. Since the plurality of grooves communicate from the central portion of the surface portion of the pad to the edge portion, respectively, the slurry that has contributed to the polishing and has dropped in the grooves is exhausted from the edge portion to the outside.

The invention in another embodiment provides the polishing method where the member to be suspended on the pad surface comprises a plurality of wire-like members, a brush-like member, or a bristle-like member.

According to the constitution, slurry flows down to the pad surface evenly by capillary action occurring due to interfacial tension acting between the slurry and the plurality of wire-like members, the brush-like member, or the bristle-like member, so that it is applied and spread on the pad surface evenly and thinly.

The invention in another embodiment provides the polishing method where the plurality of grooves is formed in either one of a radial shape or a grid shape comprising linear elements or arc-like elements.

According to the configuration, by forming the plurality of grooves in a radial or grid shape, respective grooves communicating from the central portion of the surface portion of the pad to the edge portion can be obtained. The slurry that has contributed to polishing and the polishing by-product that has occurred during the polishing are dropped in the respective grooves efficiently according to the relative movement between the wafer and the polishing face of the pad.

The invention in another embodiment provides a polishing method where a polishing face is supplied with slurry and polishing is performed by relative movement between the polishing face and a wafer, wherein a mechanism that suspends a member on a pad surface to bring the member in contact with or cause the member to approach the pad surface and supplies the slurry along the member to apply the slurry to the pad surface is provided, a surface of the pad applied for polishing has a plurality of grooves communicating from a central portion of a surface portion of the pad to an edge portion thereof, and a step of supplying pure water along the respective grooves during a polishing processing to remove polishing by-product from the edge portion to the outside of the pad is provided.

According to the constitution, a distal end of the member is disposed so as to contact with or approach the pad surface, supplying of slurry to a polishing face on the pad is performed by flowing the slurry down along the member. Even if the slurry that has flowed down is small in quantity, it spreads evenly on the polishing face due to interfacial tension acting between the polishing face of the pad and the member, and it is supplied to the polishing face of the pad according to relative movement between the member and the pad evenly and thinly. Thus, fresh slurry is constantly supplied to the polishing face of the pad via the member. A wafer is polished on the polishing face on which fresh slurry is constantly supplied evenly and thinly by relative movement between the wafer and the pad. Polishing sub-product with grinding sludge and pad dusts that has been generated during the polishing drops in the plurality of grooves according to relative movement between the wafer and the polishing face. Since the plurality of grooves communicate from the central portion of the surface portion of the pad to the edge portion thereof, respectively, the polishing sub-product staying the grooves are removed from the edge portion to the outside of the pad efficiently by supplying pure water along the respective grooves.

The invention in another embodiment provides the polishing method comprising a mechanism of supplying pure water along the respective grooves during the polishing processing and a step of removing polishing by-product from a pad central portion to a pad outer peripheral portion while rotating the pad.

According to the constitution, by supplying pure water along he respective grooves while rotating the pad during polishing processing, polishing by-product staying in the respective grooves is efficiently removed from the edge portion to the outside of the pad with the assistance with centrifugal force.

The invention in another embodiment provides the polishing method wherein interiors of the plurality of grooves are subjected to water-repellent treatment.

According to the constitution, when supplying of pure water is conducted along the respective grooves during the polishing processing, removal performance of the polishing by-product staying in the grooves is further elevated owing to the water-repellent action of the inner faces of the grooves.

The invention in another embodiment provides the polishing method wherein, in a step of supplying pure water along the respective grooves to remove polishing by-product from the edge portion to the outside of the pad while rotating the pad and a mechanism that a polishing face is supplied with slurry and polishing is performed by relative movement between the polishing face and a wafer, a mechanism that suspends a member on a pad surface to bring the member in contact with or cause the member to approach the pad surface and supplies the slurry along the member to apply the slurry to the pad surface is provided, a surface of the pad applied for polishing has a plurality of grooves communicating from a central portion of a surface portion of the pad to an edge portion thereof, and in a step of supplying pure water along the respective grooves during a polishing processing to remove polishing by-product from the edge portion to the outside of the pad, a step of removing the polishing by-product includes a mechanism that has a nozzle supplying high-pressure water, the nozzle being attached to an arm, where high-pressure water exhausted from the nozzle acts from a pad central portion to a pad outer peripheral portion according to pivoting of the arm.

According to the constitution, since high-pressure water is discharged from the nozzle attached to the arm during a polishing processing so as to act from the central portion of the pad surface to the outer peripheral portion and polishing by-product staying in the grooves is removed remarkably efficiently from the edge portion to the outside of the pad according to pivoting of the arm.

The invention in another embodiment provides the polishing method wherein the mechanism that applies the slurry on the pad surface has a mechanism that is extended from the pad central portion to the edge portion and simultaneously applies slurry on the pad from the pad central portion to the edge portion according to rotation of the pad.

According to the constitution, the mechanism that applies slurry on the pad surface is constituted so as to extend from the central portion of the pad to the edge portion in the radial direction, where slurry flowing down along the member is applied on the whole surface of the pad surface from the central portion of the pad surface to the edge portion evenly and thinly in a spreading manner according to rotation of the pad.

The invention in another embodiment provides a polishing apparatus that supplies slurry to a polishing face and performs polishing according to relative movement between the polishing face and a wafer, comprising: a slurry supplying mechanism that comprises a brush-like or filament-like member and causes slurry to flow down along the same to apply the slurry on a pad surface; and a pad rinse mechanism for washing the pad surface during a polishing processing.

According to the constitution, slurry flows down evenly to the pad surface according to capillary action caused by interfacial tension acting between the slurry and the brush-like or filament-like member. Even if the slurry that has flowed down is small in quantity, it spreads evenly on the polishing face due to interfacial tension acting between the polishing face of the pad and the member, and it is supplied to the polishing face of the pad according to relative movement between the member and the pad evenly and thinly. Thus, fresh slurry is constantly supplied to the polishing face of the pad via the member. A wafer is polished on the polishing face on which fresh slurry is constantly supplied evenly and thinly by relative movement between the wafer and the pad. Slurry that has contributed to the polishing and polishing by-product that has occurred during polishing drop in the respective grooves on the pad according to relative movement between the wafer and the polishing face of the pad. The pad surface is washed during a polishing processing by the pad rinse mechanism so that the slurry that has contributed to the polishing and the polishing by-product that have dropped in the grooves are removed from the edge portion to the outside of the pad.

The invention in another embodiment provides the polishing apparatus, wherein the mechanism for washing the pad surface during a polishing processing has a mechanism that has a nozzle supplying high-pressure water, the nozzle being attached to an arm, where high-pressure water discharged from the nozzle acts from a pad central portion to a pad outer peripheral portion according to pivoting of the arm.

According to the constitution, high-pressure water is discharged from the nozzle attached to the arm so as to act from the central portion of the pad surface to the outer peripheral portion during a polishing processing and slurry that has contributed to polishing and polishing by-product that have dropped in the grooves are removed from the edge portion to the outside of the pad efficiently according to pivoting of the arm.

The invention in another embodiment provides the polishing apparatus, wherein the member supplying the slurry is formed of a plurality of wire members, a plate member formed with grooves, or a brush-like member obtained by bundling filament-like members.

According to the constitution, slurry flows down on the member for supplying slurry to the polishing face of the pad evenly according to capillary action caused by interfacial tension acting between the slurry and the plurality of wire-like members, the plate-like member formed with grooves, or the brush-like member so that it is applied on the polishing face evenly and thinly in a spreading manner.

The invention in another embodiment provides the polishing apparatus, wherein the member for supplying the slurry is disposed in a radial direction of the pad so as to be directed from a central portion of the pad toward a peripheral portion thereof.

According to the constitution, the member for supplying slurry can be caused to approach or come in contact with the whole surface of the polishing face on the pad. Thereby, slurry can be supplied to the whole surface of the polishing face on the pad evenly and thinly.

The invention in another embodiment provides the polishing apparatus, wherein the member for supplying the slurry is constituted such that a distal end portion thereof does not contact with bottom portions of the respective grooves.

According to the constitution, fresh slurry is prevented from being supplied to the respective grooves serving to exhaust the slurry that has contributed to polishing and the polishing by-product to the outside of the pad. Climbing of slurry that has contributed to polishing and polishing by-product that accumulate in the grooves on the polishing face of the pad is suppressed.

In the invention in one embodiment, since the mechanism that suspends a member on a pad surface to bring the member in contact with or cause the member to approach the pad surface, supplying the slurry along the member to apply the slurry to the pad surface is provided, a surface of the pad applied for polishing has the plurality of grooves communicating from a central portion of a surface portion of the pad to an edge portion thereof, slurry is supplied white the slurry is being applied to the pad surface, and slurry that has contributed to polishing is dropped in the grooves of the pad to be exhausted, supplying of slurry to the polishing face on the pad is performed by causing the slurry to flow down along the member, so that, even if the slurry is small in quantity, it can be applied on the polishing face evenly and thinly in a spreading manner owing to interfacial tension acting between the polishing face of the pad and the member. Accordingly, a wafer can be polished on the polishing face constantly supplied with fresh slurry evenly and thinly. The slurry that has contributed to polishing can be dropped in the plurality of grooves communicating from the central portion of the pad surface portion to the edge portion thereof according to relative movement between the wafer and the polishing face to be exhausted outside the pad. As a result, such an advantage can be achieved that an even polished shape can be secured, scratches due to the polishing by-product contained in the slurry that has contributed to polishing can be reduced, and low cost during running for mass production can be realized while consumption of slurry is being suppressed to the minimum.

In the invention in one embodiment, since the member to be suspended on the pad surface comprises the plurality of wire-like, the brush-like, or the bristle-like members, such an advantage can be achieved that slurry can flow down along the member to the pad surface evenly due to capillary action to be applied and spread on the pad surface evenly and thinly.

In the invention in one embodiment, since the plurality of grooves are formed in either one of a radial shape comprising linear sections or arc sections or a grid shape, such an advantage can be achieved that a plurality of grooves communicating from the central portion of the surface portion of the pad to the edge portion, respectively, can be formed and slurry that has contributed to polishing and polishing by-product that has occurred during polishing can be dropped in the respective grooves efficiently according to relative movement between the wafer and the polishing face of the pad.

In the invention in one embodiment, since the mechanism that suspends a member on a pad surface to bring the member in contact with or cause the member to approach the pad surface and supplies the slurry along the member to apply the slurry to the pad surface is provided, a surface of the pad applied for polishing has the plurality of grooves communicating from a central portion of a surface portion of the pad to an edge portion thereof, and a step of supplying pure water along the respective grooves during a polishing processing to remove polishing by-product from the edge portion to the outside of the pad is provided, supplying of slurry to the polishing face on the pad is performed by causing the slurry to flow down along the member, so that, even if the slurry is small in quantity, it can be applied and spread on the polishing face evenly and thinly owing to interfacial tension acting between the polishing face of the pad and the member. Accordingly, a wafer can be polished on the polishing face constantly supplied with fresh slurry evenly and thinly. The polishing by-product that has occurred during polishing are dropped in the plurality of grooves communicating from the central portion of the pad surface portion to the edge portion thereof according to relative movement between the wafer and the polishing face and pure water is supplied along the respective grooves during the polishing processing so that the polishing by-product can be removed from the edge portion to the outside of the pad efficiently. As a result, such an advantage can be achieved that an even polished shape can be secured, scratches due to the polishing by-product can be reduced, and low cost during running for mass production can be realized while consumption of slurry is being suppressed to the minimum.

Here, as a method for exhausting polishing by-product outside the pad efficiently, various methods have been proposed conventionally. However, consideration must be made including not only exhaust of slurry but also supply thereof. An original meaning of improving polishing quality and suppressing occurrence of scratches lies in that two factors for supplying slurry to cause the same to contribute to polishing while retaining the slurry and for making exclusion performance excellent are provided. Therefore, a mechanism specialized to improvement of exclusion performance in the conventional art does not consider supplying of fresh slurry conducted after exhaust at all, where slurry supply cannot be performed efficiently As a result, much slurry is exhausted wastefully. Supplying (Exhausting?) much slurry wastefully causes such an adverse effect as increase of a mixing ratio of foreign matter particles contained in the slurry eventually, so that the specialized mechanism does not serve as a mechanism for reducing scratches. By conducting setting such that fresh slurry is supplied and the slurry is supplied to the whole surface of the pad without passing through the grooves, effective slurry supply can be realized and slurry with high quality can be supplied stably by maintaining a minimal slurry supply. Slurry constantly flowing in one direction without mixing used slurry can improve exclusion performance of polishing by-product in grooves.

In the invention in one embodiment, since the mechanism that supplying pure water along the respective grooves during the polishing processing and a step of removing polishing by-product from a pad central portion to a pad outer peripheral portion while rotating the pad are provided, such an advantage can be achieved that polishing by-product staying in the respective grooves can be removed from the edge portion to the outside of the pad efficiently with the assistance with centrifugal force by supplying pure water along the respective grooves during a polishing processing while rotating the pad.

In the invention in one embodiment, since interiors of the plurality of grooves are subjected to water-repellent treatment, such an advantage can be achieved that, when supply of pure water is conducted along the respective grooves during a polishing processing, removal performance of the polishing by-product staying in the grooves can be further improved owing to water-repellant action of the respective groove inner faces.

In the invention in one embodiment, since, in a step of supplying pure water along the respective grooves to remove polishing by-product from the edge portion to the outside of the pad while rotating the pad and a mechanism that a polishing face is supplied with slurry and polishing is performed by relative movement between the polishing face and a wafer, a mechanism that suspends a member on a pad surface to bring the member in contact with or cause the member to approach the pad surface and supplies the slurry along the member to apply the slurry to the pad surface is provided, a surface of the pad applied for polishing has a plurality of grooves communicating from a central portion of a surface portion of the pad to an edge portion thereof, and in a step of supplying pure water along the respective grooves during a polishing processing to remove polishing by-product from the edge portion to the outside of the pad, a step of removing the polishing by-product includes a mechanism that has a nozzle supplying high-pressure water, the nozzle being attached to an arm, where high-pressure water discharged from the nozzle acts from a pad central portion to a pad outer peripheral portion according to pivoting of the arm, such an advantage can be achieved that polishing by-product staying in the grooves can be removed from the edge portion to the outside of the pad considerably efficiently by discharging high-pressure water from the nozzle so as to act the central portion of the pad surface to the outer peripheral portion thereof during a polishing processing and pivoting the arm attached with the nozzle.

In the invention in one embodiment, since the mechanism that is extended from the pad central portion to the edge portion in the radial direction and simultaneously applies slurry on the pad from the pad central portion to the edge portion according to rotation of the pad is provided, such an advantage can be achieved that slurry can be applied and spread on the whole surface of the pad surface from the central portion of the pad surface to the edge portion thereof evenly and thinly by constituting the member applying slurry on the pad surface so as to extend from the central portion of the pad to the edge portion in the radial direction and rotating the pad.

In the invention, since a polishing apparatus that supplies slurry to a polishing face and performs polishing according to relative movement between the polishing face and a wafer, comprises: a slurry supplying mechanism that comprises a brush-like or filament-like member and causing slurry to flow down along the same to apply the slurry on a pad surface; and a pad rinse mechanism for washing the pad surface during a polishing processing, supply of slurry to the polishing face on the pad is performed by causing slurry to flow down along the member, so that, even if the slurry is small in quantity, it can be applied and spread on the polishing face evenly and thinly due to interfacial tension acting between the polishing face of the pad and the member. Accordingly, a wafer can be polished on the polishing face constantly supplied with fresh slurry evenly and thinly. The slurry that has contributed to polishing and the polishing by-product are caused to drop in the respective grooves on the pad according to relative movement between the wafer and the polishing face and the pad surface is washed by the pad rinse mechanism during a polishing processing, so that the slurry and the polishing by-product can be removed from the edge portion to the outside of the pad. As a result, such an advantage can be achieved that an even polished shape can be secured, scratches due to the polishing by-product can be reduced, and low cost during running for mass production can be realized while consumption of slurry is being suppressed to the minimum.

In the invention in one embodiment, since the mechanism for washing the pad surface during a polishing processing has a mechanism that has a nozzle supplying high-pressure water, the nozzle being attached to an arm, where high-pressure water discharged from the nozzle acts from a pad central portion to a pad outer peripheral portion according to pivoting of the arm, such an advantage can be achieved that slurry that has contributed to polishing and polishing by-product that have dropped in the grooves Can be removed from the edge portion to the outside of the pad considerably efficiently by discharging high-pressure water from the nozzle so as to act from the central portion of the pad surface to the outer peripheral portion thereof during a polishing processing and further pivoting the arm attached with the nozzle.

In the invention in one embodiment, since a member supplying the slurry is formed of a plurality of wire-like members, a plate-like member formed with grooves, or a brush-like member obtained by bundling filament-kike members, such an advantage can be achieved that the slurry evenly flows down to the polishing face of the pad along the member supplying slurry due to capillary action to apply and spread the slurry on the polishing face evenly and thinly.

In the invention in one embodiment, since the member supplying the slurry is disposed in a radial direction of the pad so as to be directed from a central portion of the pad toward a peripheral portion thereof, the member supplying slurry can be caused to approach or contact with the whole surface of the polishing face of the pad widely. As a result, such an advantage can be achieved that slurry can be supplied to the whole surface of the polishing face on the pad evenly and thinly.

In the invention in one embodiment, since the member supplying the slurry is constituted such that a distal end portion thereof does not contact with bottom portions of the respective grooves, such an advantage can be achieved that fresh slurry can be prevented from being supplied to the respective grooves serving to exhaust the slurry that has contributed to polishing and the polishing by-product outside the pad and climbing of slurry that has contributed to polishing and polishing by-product that stay in the grooves onto the polishing face of the pad is suppressed.

BRIEF DESCRIPTION OF THE DRAWINGS

The drawings show a polishing method and a polishing apparatus according to an embodiment of the present invention.

BEST MODE FOR CARRYING OUT THE INVENTION

In order to achieve such an object as to secure an even polished shape and remove slurry that has contributed to polishing and includes polishing by-product outside a pad efficiently, reduce scratches due to the polishing by-product, and suppress consumption of slurry to the minimum to realize cost-reduction during running for mass production, a polishing method where a polishing face is supplied with slurry and polishing is performed by relative movement between the polishing face and a wafer is realized such that a mechanism that suspends a member on a pad surface to bring the member in contact with or cause the member to approach the pad surface and supplies the slurry along the member to apply the slurry to the pad surface is provided, a surface of the pad applied for polishing has a plurality of grooves communicating from a central portion of a surface portion of the pad to an edge thereof, and a step of supplying pure water along the respective grooves during a polishing processing to remove polishing by-product from the edge portion to the outside of the pad is provided.

Figure 1:
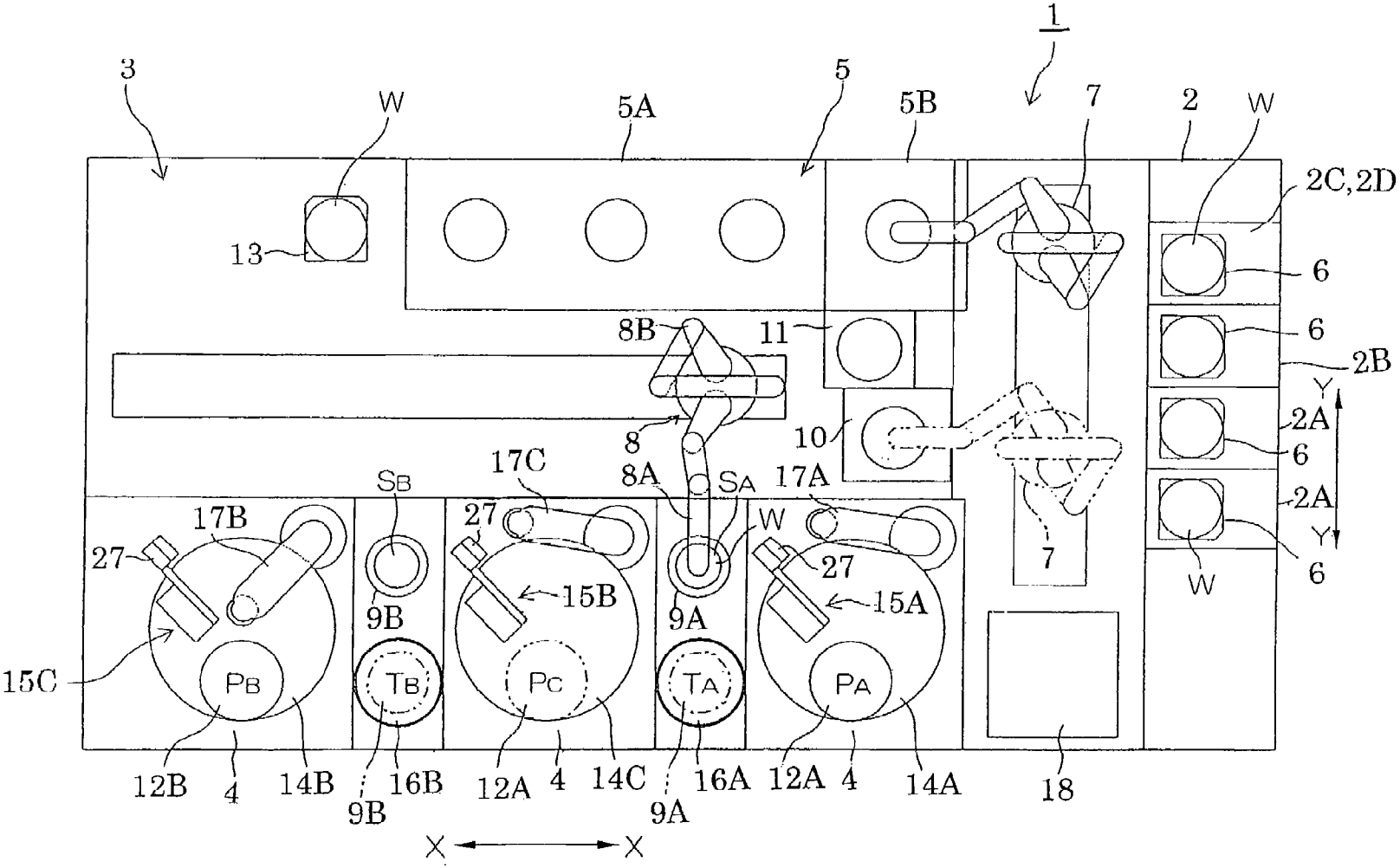
FIG. 1 is a whole configuration diagram of a polishing apparatus to which the present invention is applied.
Figure 2:
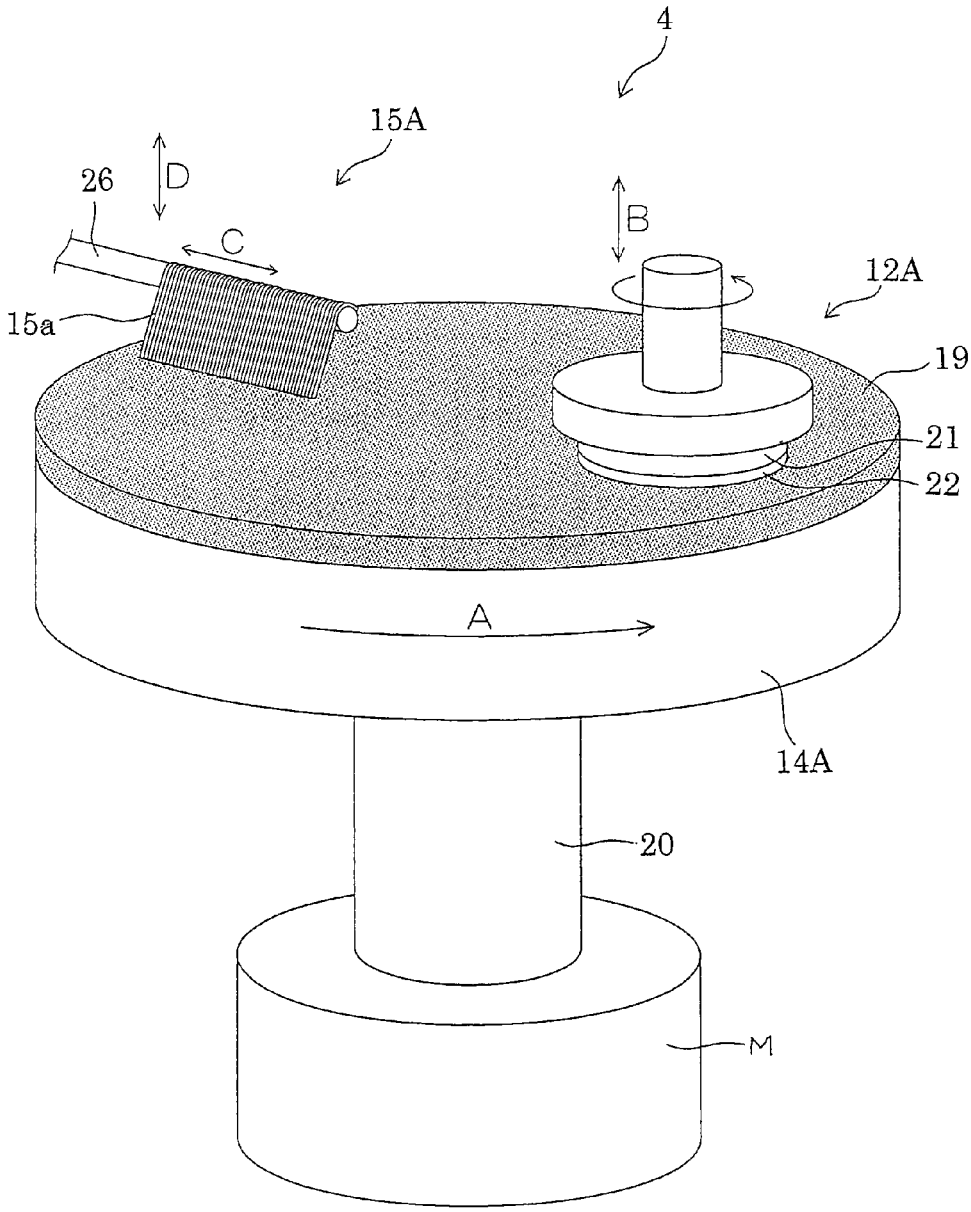
FIG. 2 is a perspective view showing a constitution of a polishing unit.
Figure 3A:
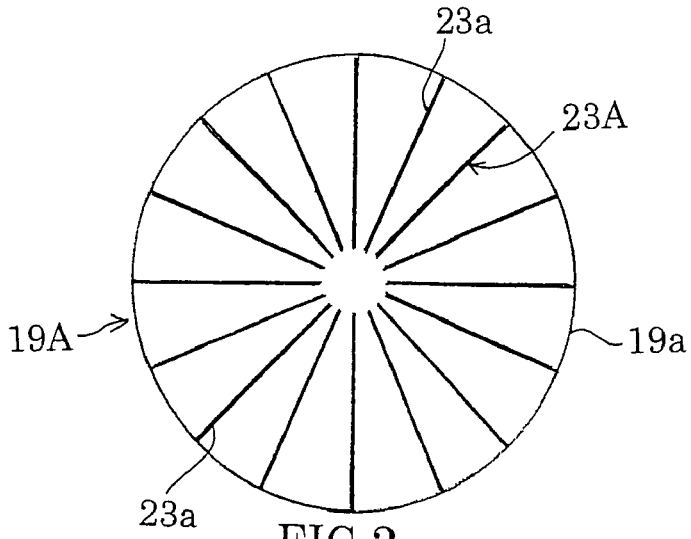
FIGS. 3A, 3B, and 3C are plan views of a radial pad grooves made of linear groove elements, a radial pad grooves made of arc groove elements, and a grid-like pad grooves.
Figure 3B:
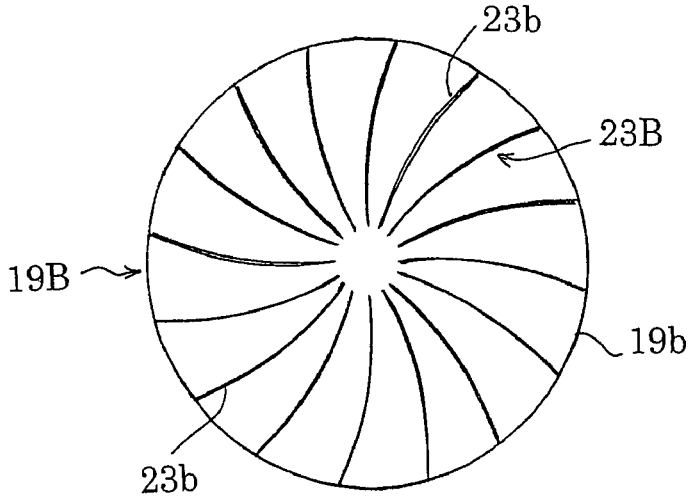
Figure 3C:
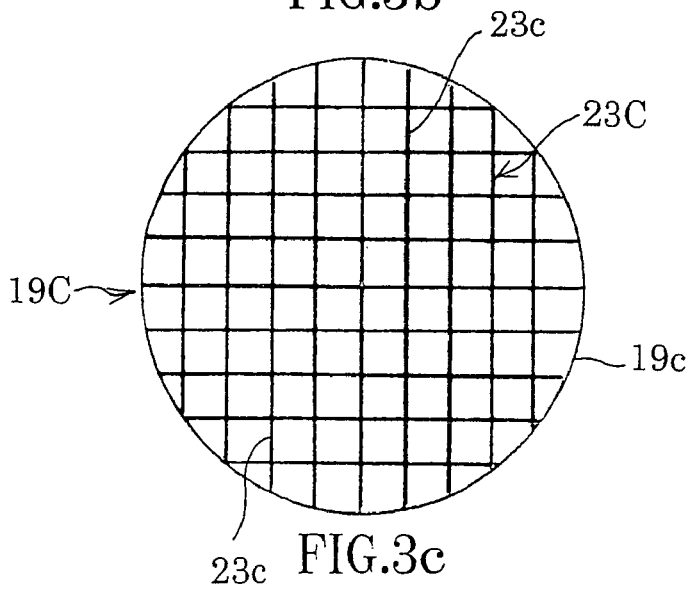
Figure 4:
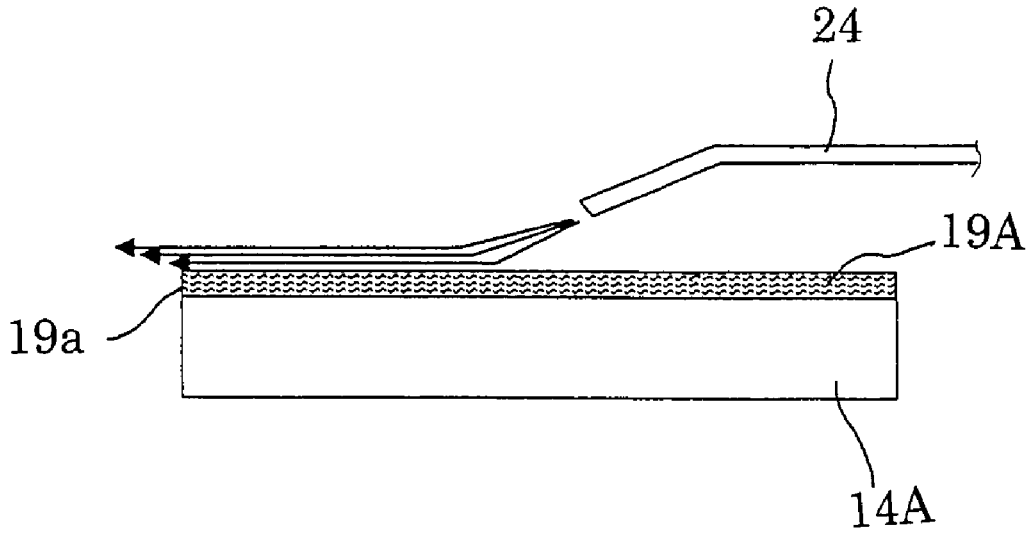
FIG. 4 is a perspective view showing a groove washing nozzle for washing pad grooves.
Figure 5:
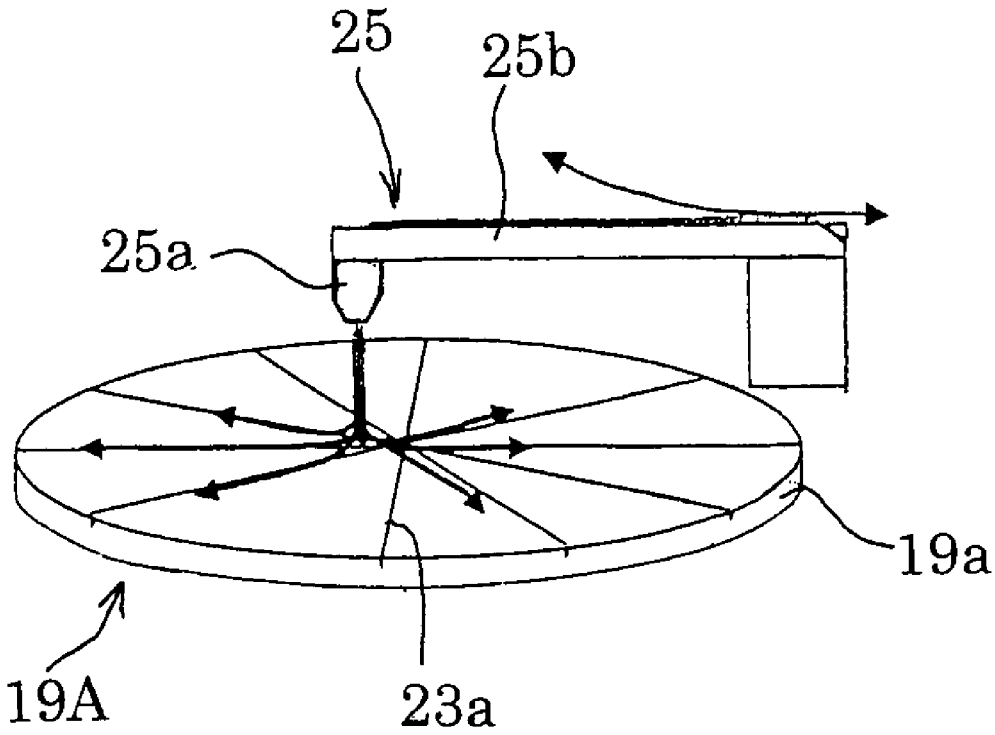
FIG. 5 is a perspective view showing a groove washing high-pressure water nozzle including a pivoting mechanism.

A preferable embodiment of the present invention will be explained below in detail with reference to the drawings. FIG. 1 is a whole configuration diagram of a polishing apparatus, FIG. 2 is a perspective view showing a configuration of a polishing means, FIGS. 3A, 3B, 3C are plan views of a radial pad grooves made of linear groove elements, a radial pad grooves made of arc groove elements, and a grid-like pad grooves, FIG. 4 is a perspective view showing a groove washing nozzle for washing pad grooves, and FIG. 5 is a perspective view showing a groove washing high-pressure water nozzle.

First, a polishing method and a polishing apparatus according to the embodiment will be explained based upon a configuration of a chemical mechanical polishing apparatus. In FIG. 1, a chemical mechanical polishing apparatus 1 mainly includes a wafer accommodating section 2, conveying means 3, a plurality of polishing means 4, 4, and 4 that constitute a polishing section, washing and drying means 5, film thickness measuring means 18, and an apparatus control section (not shown).

The wafer accommodating section 2 includes product wafer accommodating sections 2A, a dummy wafer accommodating section 2B, a first monitor wafer accommodating section 2C, and a second monitor wafer accommodating section 2D, where wafers W accommodated in a cassette 6 is accommodated in each accommodating section. Two product wafer accommodating section 2A are provided side by side. A lower stage of the cassette 6 is used as the first monitor wafer accommodating section 2C, while an upper stage of the cassette 6 is used as the second monitor wafer accommodating section 2D.

The conveying means 3 includes an indexing robot 7, a transfer robot 8, and conveying units 9A and 9B. The indexing robot 7 includes two arms that can be pivoted and can be flexed, and it is provided to be movable in a direction of arrow Y in FIG. 1.

The indexing robot 7 takes out a wafer W to be polished from the cassette 6 placed on the each wafer accommodating section to convey the same to a wafer waiting position 10 or 11 and receives a wafer W that has been washed from the washing and drying means 5 to accommodate the same in the cassette 6.

The transfer robot 8 includes a loading arm 8A and an unloading arm 8B that can be flexed and pivoted, and it is provided to be movable along a direction of arrow X in FIG. 1. The loading arm 8A is used for conveying a wafer W before polished and it receives the wafer W before polished at a pad (not shown) provided at a distal end of the loading arm to convey the same to the conveying unit 9A or 9B.

On the other hand, the unloading arm 8B is used for conveying the polished wafer W and received the wafer W polished by a pad (not shown) provided at a distal end portion of the unloading arm 8B from the conveying unit 9A or 9B to convey the same to the washing and drying means 5.

The washing and drying means 5 washes the wafer W that has been polished. The washing and drying means 5 includes a washing device 5A and a drying device 5B. The washing device 5A has three washing vessels, where the vessels are used for alkaline washing, acidic washing, and rinsing. The wafer W that has been polished by the polishing means 4, 4, or 4 is conveyed to the washing and drying means 5 by the transfer robot 8, and after the wafer W is subjected to acidic washing, alkaline washing, and rinsing by the washing device 5A of the washing and drying unit 5, it is dried in the drying device 5B. The dried wafer W is taken out of the drying device 5B by the indexing robot 7 of the conveying means 3 to be accommodated at a predetermined position in the cassette 6 set in the wafer accommodating section 2.

The conveying units 9A and 9B are respectively provided to be movable along the direction of arrow Y in FIG. 1, and they are moved between receiving positions SA and SB and delivering positions TA and TB, respectively. The conveying units 9A and 9B receive wafers W to be polished from the loading arm 8A of the transfer robot 8 in the receiving positions SA and SB and move to the delivering positions TA and TB and deliver the wafers W to the wafer holding heads 12A and 12B. The conveying units 9A and 9B receive wafers W after polished at the delivering positions TA and TB to move to the receiving positions SA and SB and deliver the wafers W to the unloading arm 8B of the transfer robot 8.

The conveying units 9A and 9B each have two reception stands independent from each other, and the two reception stands are used for a wafer W before polished and for a wafer W after polishing in a separating manner. An unload cassette 13 is provided adjacent to the washing and drying unit 5, it is used as a place for temporarily accommodating the wafer W after polishing. For example, the wafer W after polished is conveyed by the transfer robot 8 to be temporarily accommodated in the unload cassette 13 during running suspension of the washing and drying means 5.

The polishing means 4, 4, and 4 perform polishing of wafer W and they each include a platen 14A, 14B, or 14C, a polishing head 12A or 12B, a slurry supplying means 15A, 15B, or 15C serving as a slurry supplying mechanism, and a carrier washing unit 16A or 16B. The carrier washing units 16A and 16B are disposed on the predetermined delivering positions TA and TB of the conveying units 9A and 9B and they wash carriers (not shown) on the polishing heads 12A and 12B after polishing.

The platens 14A, 14B, and 14C are each formed in a circular shape and the three platens are arranged in parallel. Upper faces of the respective platens 14A, 14B, and 14C are bonded with polishing pads, as described later, and slurry is supplied on the polishing pads from the slurry supplying means 15A, 15B, and 15C.

Left and right platens 14A and 14B of the three platens 14A, 14B, and 14C are used for polishing a first film to be polished (for example, a Cu film), while a central platen 14C is used for polishing a second film to be polished (for example, a Ta film). Both polishing processings are different in kind of slurry to be supplied, rotation speeds of the polishing heads 12A and 12B, a rotation speed of the platens 14A, 14B, and 14C, pressing forces of the polishing heads 12A and 12B, or materials of the polishing pads, or the like.

Dressing devices 17A, 17B, and 17C are provided near the three platens 14A, 14B, and 14C, respectively. The dressing devices 17A, 17B, and 17C have arms that can be pivoted, where polishing pads on the platens 14A, 14B, and 14C are dressed by dressers provided at distal end portions of the arms.

Two polishing heads 12A and one polishing head 12B are installed and they can move in the direction of arrow X in FIG. 1, respectively.

As shown in FIG. 2, the polishing means 4 has a polishing pad 19 bonded on an upper face of the platen 14A. A rotational shaft 20 is coupled to an output shaft (not shown) of a motor M at a lower portion of the platen 14A, and the platen 14A is rotated in a direction of arrow A by driving the motor M.

The polishing head 12A includes a guide ring 21, a retainer ring 22, and the like at a lower portion thereof, and a carrier (not shown) for sucking and fixing a wafer W is provided inside the polishing head 12A. The polishing head 12A is moved in a direction of arrow B by a moving mechanism (not shown) to press the sucked and fixed wafer W to the polishing pad 19.

FIGS. 3A, 3B, and 3C show pad grooves formed on surface portions of polishing pads 19, in which polishing by-product including polishing sludge, pad dusts, and the like generated during polishing together with slurry that has contributed to polishing is dropped for removal. The pad grooves are formed of a radial pad groove 23A (FIG. 3A) composed of a plurality of linear groove elements 23*a*, a radial pad groove 23B (FIG. 3B) composed of a plurality of arc groove elements 23*b*, and a grid-shaped pad groove 23C (FIG. 3C) composed of a plurality of linear groove elements 23*c*.

The respective linear groove elements 23*a* in the pad groove 23A communicate from a central portion of the polishing pad 19A to an edge portion 19*a*, the respective arc-shaped groove elements 23*b* in the pad groove 23B communicate from a central portion of the polishing pad 19B to an edge portion 19*b*, and the respective linear groove elements 23*c* in the pad groove 23C communicate from a surface portion of the polishing pad 19C to an edge portion 19*c*.

Respective inner faces of the linear groove elements 23*a* and 23*c*, and the arc-shaped groove elements 23*b* are respectively subjected to water-repellant treatment by water-repellent members such as Teflon (registered trademark).

The pad grooves 23A and 23B are each formed in a radial shape and the pad groove 23C is formed in a grid shape so that polishing by-product generated during polishing and slurry that has contributed to polishing and which includes the polishing by-product are caused to drop in the respective linear groove elements 23*a* and 23*c* and the respective arc-shaped groove elements 23*b* according to relative movement between the wafer W and the pad 19A, 19B, or 19C efficiently.

The plurality of linear groove elements 23*a*, the plurality of arc-shaped groove elements 23*b*, and the plurality of linear groove elements 23*c* communicate from the central portion or the surface portion of the polishing pads 19A, 19B, and 19C to the edge portions 19*a*, 19*b*, and 19*c*, and water-repellant treatment is applied to the respective groove element inner faces, so that when supply of pure water or the like is performed along the respective groove elements 23*a*, 23*b*, and 23*c* during polishing while the polishing pads 19A, 19B, and 19C are being rotated, polishing by-product staying in the groove elements 23*a*, 23*b*, and 23*c* and slurry that has contributed to polishing and contains the polishing by-product are removed efficiently from the edge portions 19*a*, 19*b*, and 19*c* to the outside of the polishing pads 19A, 19B, and 19C.

As shown in FIG. 4, a groove washing nozzle 24 for supplying pure water along the respective groove elements 23*a* (23*b*, or 23*c*) during a polishing processing when polishing by-product together with slurry that has contributed to polishing is removed from the respective groove elements 23*a* is provided properly above the polishing pad 19A (19B, or 19C). Pure water is jetted from the groove washing nozzle 24 with high pressure so that the polishing by-product together with the slurry that has contributed to polishing is removed from the edge portion 19*a* to the outside of the polishing pad 19A.

FIG. 5 shows a groove washing high-pressure water nozzle 25 for removing polishing by-product together with slurry that has contributed to polishing from the respective groove elements 23*a* outside the polishing pad 19A further efficiently. The groove washing high-pressure water nozzle 25 is configured such that a nozzle main unit 25*a* that supplies high-pressure water is attached to an arm 25*b* and high-pressure water jetted from the nozzle main unit 25*a* acts from the central portion of the polishing pad 19A to the edge portion 19*b* according to pivoting of the arm 25*b*.

Figure 6:
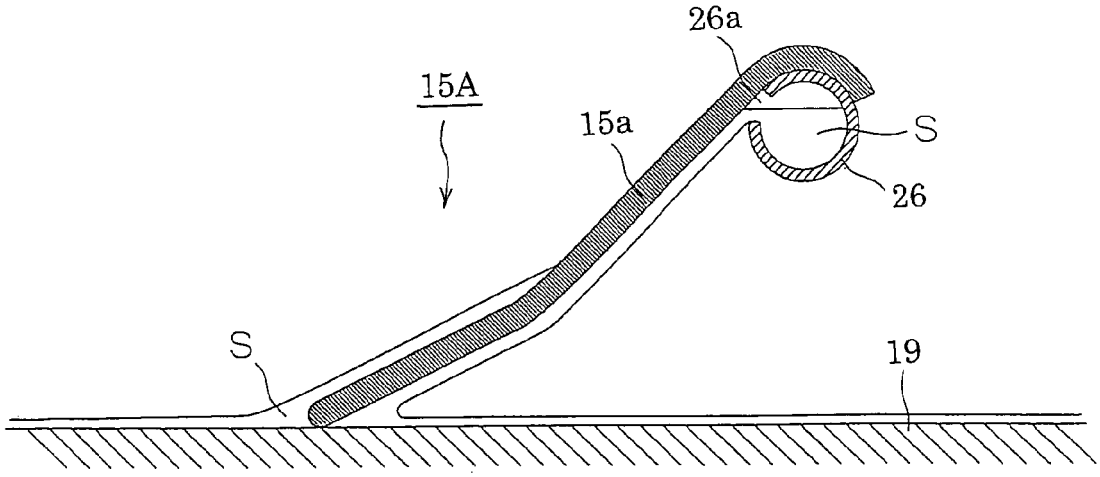
FIG. 6 is a side sectional view of a slurry supplying member and a slurry supplying pipe.

As shown in FIG. 6, the slurry supplying means 15A includes a slurry supplying member 15*a* provided so as to contact with a slit 26*a* formed horizontally on a side face of the slurry supplying pipe 26. The slurry supplying member 15*a* is installed in a radial direction of the polishing pad 19 from the central portion of the polishing pad to a peripheral portion thereof.

The slurry supplying means 15A can be moved (extended) in a direction of arrow C or in a direction of arrow D by a moving mechanism (not shown), and an inclination sensor 27 that measures levelness of the slurry supplying pipe 26 is provided at an end portion of the slurry supplying pipe 26.

The slurry supplying pipe 26 is formed of a tubular member and is formed on a side face thereof with a slit 26*a* in parallel with the polishing pad 19, one end thereof is sealed, and the slurry supplying pipe 26 is supplied with slurry S to be used for polishing from a slurry tank (not shown) though the other end thereof opened by a pump (not shown).

As shown in FIG. 6, slurry S supplied to the slurry supplying pipe 26 is reserved in the slurry supplying pipe 26, and, when the slurry S exceeds a predetermined amount, it flows out of the slit 26*a* and it flows down through the slurry supplying member 15*a* to be supplied to the polishing face of the polishing pad 19.

The slurry supplying member 15*a* is formed of a plurality of wire-like members, a plate-like member whose surface is formed with grooves, a plate-like and brush-like member obtained by bundling filament-like members, or a bristle-like member.

The slurry supplying member 15*a* is caused to approach the polishing face of the polishing pad 19 up to a distance where a droplet of slurry S is not formed at a distal end of the slurry supplying member 15*a* or is brought in contact with the polishing face of the polishing pad 19, but arrangement is conducted such that the distal end portion thereof does not contact with bottom portions of the respective groove elements 23*a*, 23*b*, and 23*c*. This arrangement is for preventing fresh slurry S from being supplied in the respective groove elements 23*a*, 23*b*, and 23*c* serving to exhaust polishing by-product together with slurry that has contributed to polishing outside the polishing pad 19.

A specific distance where the slurry supplying member 15*a* approaches the polishing pad 19 in such an extent that a droplet of slurry S is not formed at a distal end thereof can be calculated in the following method. For example, it is assumed that a water droplet drops from a circular pipe with an outer diameter of 5 mm. A face tension of water is 72.8 mN/m at a temperature of 20° C. When the outer diameter is 5 mm, an outer circumferential length is about 15.7 mm. Since a surface tension of 72.8 mN/m acts over a length of 15.7 mm, a stress sustaining one water droplet against gravity reaches 1.14 mN. Here, since acceleration due to gravity is 9.8 $m/s^2$, a weight of water droplet that can be sustained is 0.117 g. Since this value corresponds to a volume of 117 $mm^3$, a radius of a water droplet calculated becomes about 3 mm. Therefore, an outer diameter of water droplet dropping from the circular pipe with an outer diameter of 5 mm becomes 6 mm.

Thereby, in a length from a lower face of the circular pipe with a diameter of 5 mm to a lower face of a droplet, a radius of the droplet becomes about 3 mm to 4 mm. In the case of water, an approaching distance in the embodiment means the distal end of the slurry supplying member is positioned within about 3 mm to 4 mm from the polishing pad 19. Regarding other slurry, a distance to be approach can be obtained from a radius for sustaining a droplet by obtaining a surface tension.

The slurry supplying member 15*a* is disposed to the polishing pad 19 in the above manner, and slurry S supplied evenly from the slurry supplying pipe 26 positioned at the upper portion of the slurry supplying member 15*a* flows down along the slurry supplying member 15*a* evenly due to an effect such as capillary action caused by interfacial action acting between the plurality of wire-like members, the plate-like member, or the brush-like member and fluid, or the like. Even if the slurry S that has flowed down is small in quantity, it spreads on the polishing pad 19 evenly due to interfacial action between the polishing face of the polishing pad 19 and the slurry supplying member 15*a*, so that it is supplied to the polishing face of the polishing pad 19 evenly according to rotation of the polishing pad 19 and movement of the slurry supplying member 15*a*.

Since distances between the distal end of the slurry supplying member 15*a* and the bottom portions of the respective groove elements 23*a*, 23*b*, or 23*c* formed on the polishing pad 19 are set to be larger than a size of the droplet formed from slurry S due to surface tension, slurry S is not supplied to the bottom portions of the respective groove elements 23*a*, 23*b*, or 23*c* directly, so that the slurry S is supplied to only the polishing face of the polishing pad 19 efficiently.

The plate-like member or the brush-like member used as the slurry supplying member 15*a* is made from such polymer resin material as polyamide, polyethylene, polyacetal, or polyester, or the like and it has flexibility. Thereby, the slurry supplying member 15*a* that has been brought in contact with the polishing pad 19 flexes according to a contacting force to the polishing pad 19 to press a surface of the polishing pad 19.

Figure 7:
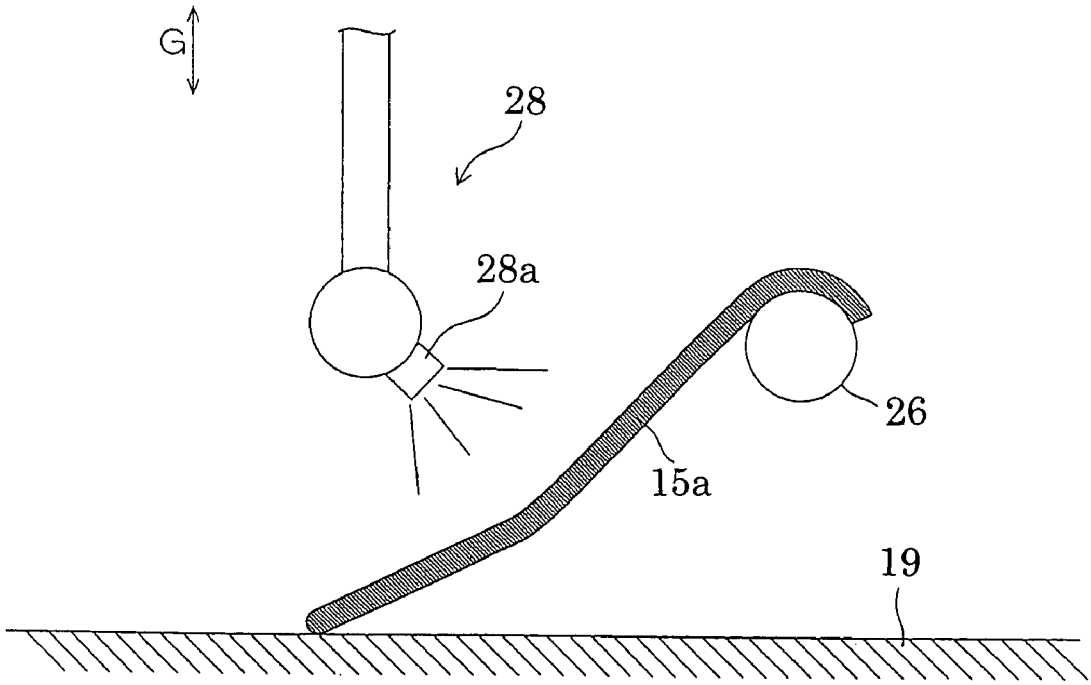
FIG. 7 is a side view of a washing apparatus washing the slurry supplying member.

As shown in FIG. 7, a washing apparatus 28 for washing slurry S on the slurry supplying member 15*a* after polishing is provided near the slurry supplying means 15A. The washing apparatus 28 jets pure water from a nozzle 28*a* to the slurry supplying member 15*a* at high pressure while moving in a direction of arrow G. Thereby, since slurry S remaining on the slurry supplying member 15*a* after polished is washed and removed from the slurry supplying member 15*a*, it is prevented from be dried and solidified on the slurry supplying member 15*a*.

Since the polishing means 4 is configured in the above manner, and a wafer W held at the polishing head 12A is pressed on the polishing pad 19 on the platen 14A, so that the wafer W is polished chemically and mechanically by supplying slurry S to the polishing pad 19 from the slurry supplying means 15A while rotating the platen 14A and the polishing head 12A, respectively. The polishing head 12B, the platens 14B and 14C, and the slurry supplying means 15B and 15C on the other side are configured similarly.

Figure 8:
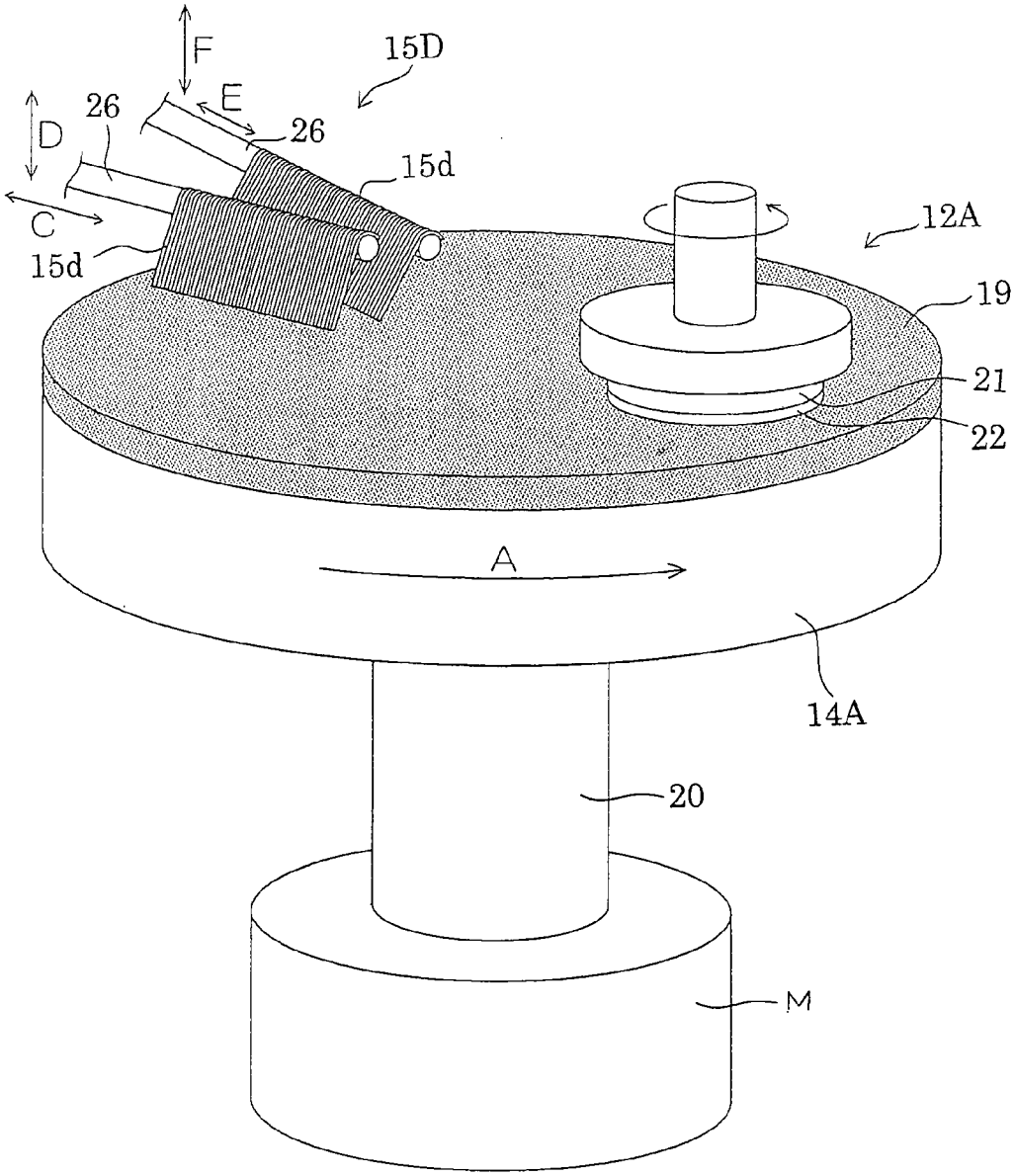
FIG. 8 is a perspective view showing a constitution of a polishing unit including a plurality of slurry supplying members.

Incidentally, in the slurry supplying mean, a plurality of sets of a slurry supplying pipe 26 and a slurry supplying member 15*d* are arranged in parallel like the slurry supplying means 15D shown in FIG. 8. Since the plurality of slurry supplying members 15*d* and 15*d* arranged conduct supply of slurry S while individually moving in directions of arrow C and arrow D and in directions of arrow E and arrow F, a region on which slurry S is supplied increases so that it is made possible to supply slurry S to the whole polishing face of the polishing pad 19 evenly and more securely.

The slurry supplying member is not limited to the plurality of wire-like members, the plate-like member formed with grooves, or the brush-like member composed of filament-like members, and a member formed by bundling fine tubular members or an accordion-like member obtained by folding a thin plate-like member may be suitably utilized as the slurry supplying member.

Figure 9:
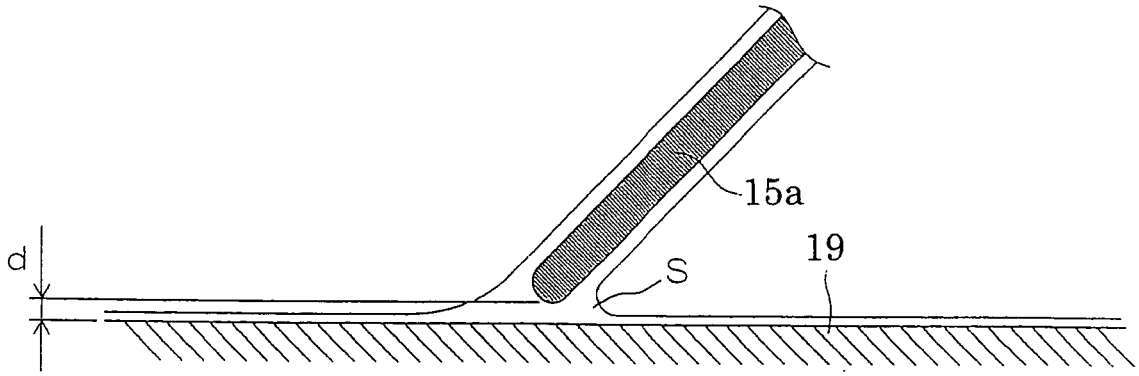
FIG. 9 is a sectional view of the slurry supplying member disposed near a polishing pad during polishing.
Figure 10:
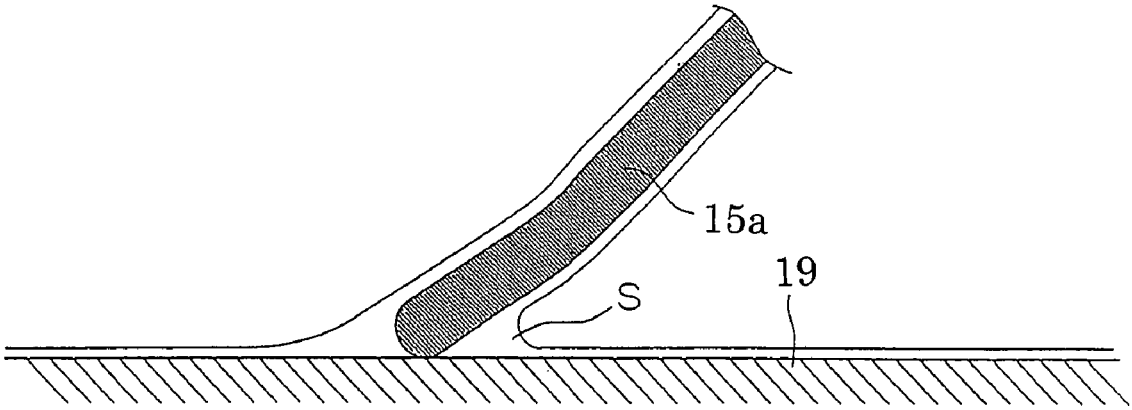
FIG. 10 is a sectional view of the slurry supplying member that has been brought in contact with the polishing pad during polishing.

Next, a polishing method of a wafer implemented by the chemical mechanical polishing apparatus thus constituted will be explained. FIG. 9 and FIG. 10 are sectional views showing distal end portions of the slurry supplying member 15*a* during polishing.

When polishing is started, a wafer W sucked and fixed to the polishing head 12A shown in FIG. 2 is pressed on the polishing pad 19 rotating in the direction of arrow A according to movement of the polishing head 12A in the direction of arrow B.

The slurry supplying means 15A is moved in the direction of arrow D and causes the distal end of the slurry supplying member 15*a* to approach or come in contact with the polishing pad 19 and slurry S is fed to the slurry supplying pipe 26 held in parallel with the polishing pad 19 according to the inclination sensor 27, so that the slurry S is supplied from the slit 26*a* to an upper portion of the slurry supplying member 15*a* evenly. The slurry S supplied to the upper portion of the slurry supplying member 15*a* evenly flows down along the slurry supplying member 15*a*.

At this time, as shown in FIG. 9, when the distal end portion of the slurry supplying member 15*a* approaches the polishing pad 19 so as to be spaced therefrom by a distance d where a water droplet is not formed due to surface tension of the slurry S, the slurry S flowing down along the slurry supplying member 15*a* is applied and spread on the polishing face of the polishing pad 19 evenly and thinly due to interfacial tension acting between the polishing pad 19 and the slurry supplying member 15*a* without forming a droplet.

As shown in FIG. 10, when the distal end portion of the slurry supplying member 15*a* comes in contact with the polishing pad 19, the slurry S flowing down to the polishing pad 19 is applied and spread on the polishing face of the polishing pad 19 evenly and thinly due to interfacial tension acting between the polishing pad 19 and the slurry supplying member 15*a*.

In the state, the slurry supplying means 15A is moved in the direction of arrow C shown in FIG. 2, so that the slurry S is supplied to the whole face of the polishing face of the polishing pad 19 according to rotation of the polishing pad 19 evenly and thinly. Thereby, even if the slurry S is small in quantity, the slurry S is applied and spread on the polishing face of the polishing pad 19 evenly and thinly.

Thus, fresh slurry S is constantly supplied to the polishing face of the polishing pad 19 via the slurry supplying member 15*a*. A wafer W is chemically and mechanically polished on the polishing face of the polishing pad 19 constantly supplied with fresh slurry S evenly and thinly according to relative movement between the both of the wafer Wand the polishing pad 19 respectively rotated. Polishing by-product including polishing sludge, pad dusts, and the like that have generated during polishing together with slurry that has contributed to polishing drops in the plurality of respective groove elements 23*a*, 23*b*, and 23*c* according to the relative movement between the wafer W and the polishing pad 19.

In addition thereto, since the slurry supplying member 15*a* has flexibility, polishing residual material such as pad dusts, coarse grinding particles, or polishing sludge staying on the surface of the polishing pad 19 is removed by adjusting a contacting force of the slurry supplying member 15*a* and performing brushing on the polishing face of the polishing pad 19.

As a result, polishing of a wafer W can be performed at low cost and with high precision without causing such a problem as generation of scratches on a face of the wafer W to be polished. The polishing head 12B, the platens 14B and 14C, and the slurry supplying means 15B and 15C on the other side also act similarly.

Figure 11:
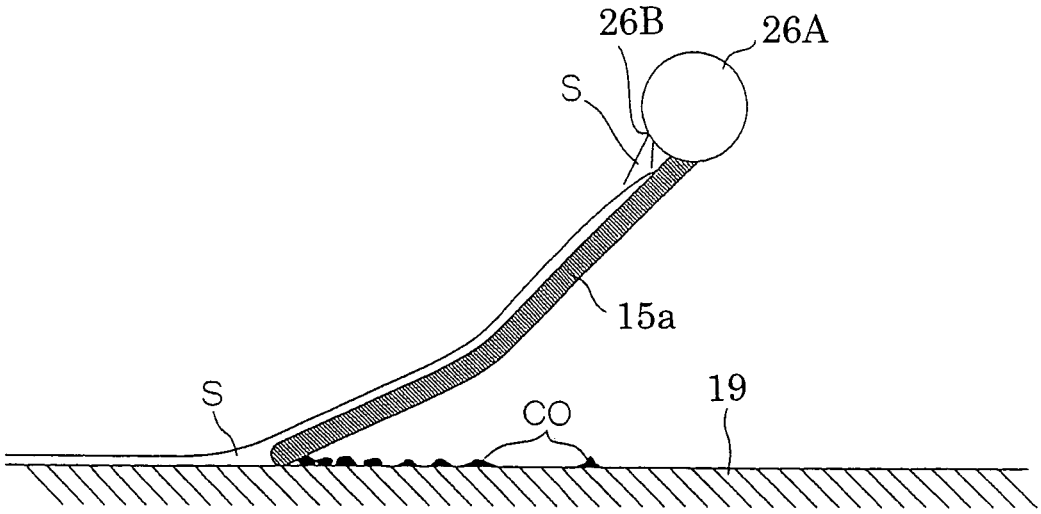
FIG. 11 is a side view of the slurry supplying member that performs washing to the polishing pad.

As shown in FIG. 11, by causing slurry S to flow down to only the upper face of the slurry supplying member 15*a* from a slurry supplying port 26B of the slurry supplying pipe 26A to supply the slurry S on the polishing pad 19 and performing removal of polishing residual material CO on a lower face side of the slurry supplying member 15*a*, fresh slurry S is evenly supplied to the surface of the polishing pad 19 cleaned by the slurry supplying member 15*a*.

Figure 12:
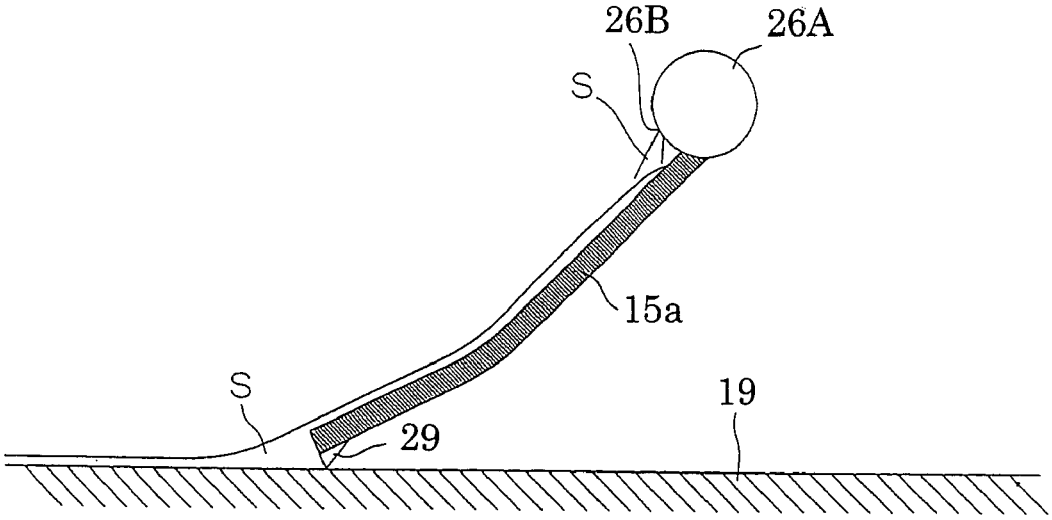
FIG. 12 is a side view of the slurry supplying member that performs dressing of the polishing pad.

As shown in FIG. 12, by providing a pad dresser 29 for performing dressing of the polishing pad 19 at a distal end portion of the slurry supplying member 15*a*, the polishing pad 19 is dressed and fresh slurry S is supplied to only the upper face of the slurry supplying member 15*a* from the slurry supplying port 26B of the slurry supplying pipe 26A, so that fresh slurry S is evenly supplied to a fresh face of the dressed polishing pad 19 from the slurry supplying member 15*a*.

With these constitutions, supply of slurry S, cleaning of the polishing pad 19, and dressing are simultaneously performed and polishing is always performed by fresh face of the dressed polishing pad 19 without mixing of polishing by-product into slurry S supplied, so that throughput is improved and polishing with high precision that does not generate scratches or the like on a face of the wafer W to be polished can be made possible. Incidentally, when the pad dresser 29 is provided at the distal end portion of the slurry supplying member 15*a*, the dressing apparatuses 17A, 17B, and 17C shown in FIG. 1 become unnecessary.

When pure water is jetted during polishing from the groove washing nozzle 24 or the groove washing high pressure water nozzle 25 along the respective groove elements 23*a*, 23*b*, and 23*c* during a polishing processing while the polishing pad 19 is being rotated, since the respective groove elements 23*a*, 23*b*, and 23*c* communicate from the central portion or the surface portion of the polishing pad 19 to the edge portion, and the inner faces of the respective groove elements 23*a*, 23*b*, and 23*c* have been subjected to the water-repellant treatment, polishing by-product staying in the groove elements 23*a*, 23*b*, and 23*c* together with slurry that has contributed to polishing is removed from the edge portion to the outside of the polishing pad 19 efficiently.

Next, referring to FIGS. 13A and 13B, a polishing result (FIG. 13A) of a wafer W according to the wafer polishing method according to the present invention and a polishing result (FIG. 13B) of a wafer W according to a conventional wafer polishing method as a conventional example will be described.

A mass production "CMP" apparatus (trade name: chaMP322) manufactured by TOKYO SEIMITSU CO. LTD. was used as the polishing apparatus.

Polishing conditions are as follows:

Wafer pressure: 3 psi

Retainer pressure: 1 psi

Rotation speed of polishing pad: 80 rpm

Rotation speed of carrier: 80 rpm

Slurry supplying rate: 100 ml/min

Polishing pad: IC1400-Pad D30.3 (manufactured by NITTA HAAS INCORPORATED)

Polishing time: 60 sec

Air flow rate: 49 L/min

Slurry: fumed silica slurry: SS25 (1:1 water dilution) (produced by CABOT CORPORATION)

Wafer: 12-inch wafer with oxide film (PETOS on Si)

Dressing method: In-situ dressing

Dressing force: 4 kgf (4-inch dresser: produced by Mitsubishi Material Corporation)

Dress swinging frequency: 1 times/10 sec

Rotation speed of dresser: 88 rpm

As a slurry supplying means with a conventional constitution, a PFA tube is disposed above a polishing pad. The PFA tube has a diameter of 6 mm and it drops slurry at a position of 50 mm from the center of the polishing pad.

In the slurry supplying means according to the present invention, a slurry supplying member is brought in contact with a polishing pad in a range from a portion of 90 mm to a portion 330 mm from the center of a polishing pad. The slurry supplying member is made of nylon fibers with a diameter of 0.1 mm to 0.2 mm and is formed by arranging about 1000 to 2000 nylon fibers in a lengthwise direction (a radial direction of the polishing pad) of a slurry supplying pipe.

After the polishing pad has been bonded to a platen, it is dressed for 30 minutes while pure water is being supplied thereto, and 25 wafers are polished at a slurry supplying rate of 300 ml/min with such a setting that a slurry dropping position is a position of 90 mm from the center of the polishing pad under the above conditions according to the conventional configuration. After polishing, confirmation is made about whether or not the wafer polishing rate is equal to or more than 2800 A/min that is a predetermined polishing rate, and a state of the polishing pad is adjusted.

In this state, polishing of wafers is conducted according to the conventional configuration and the method of the present invention. Since the respective polishing operations were conducted sequentially after replacement of the slurry supplying means, states of polishing pads and pressing conditions to wafers are equivalent to each other, both of the conventional configuration and the method of the present invention are different in only slurry supplying means.

Figure 13A:
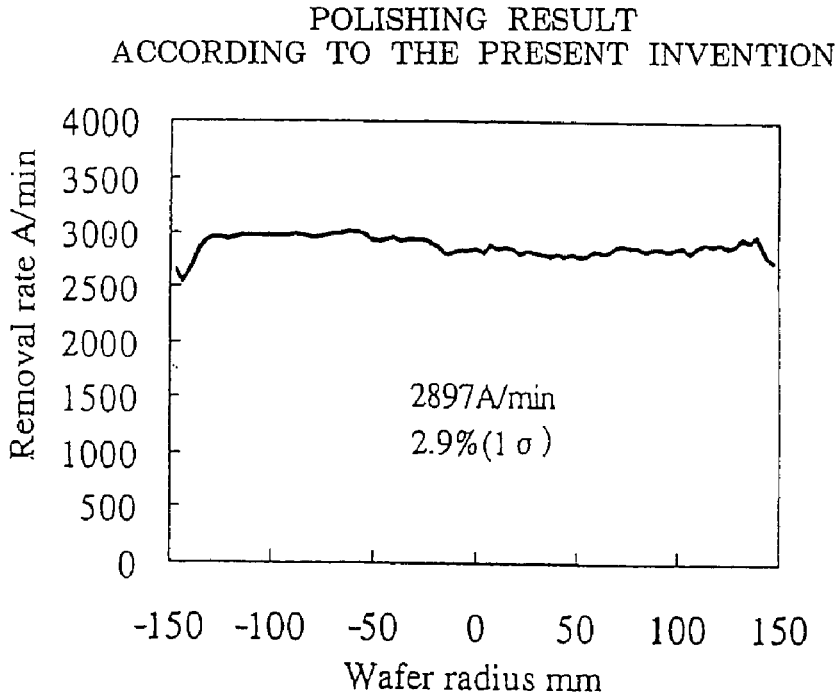
FIGS. 13A and 13B are graphs showing a polishing result of an example of the present invention and showing a polishing result of a comparative example.
Figure 13B:
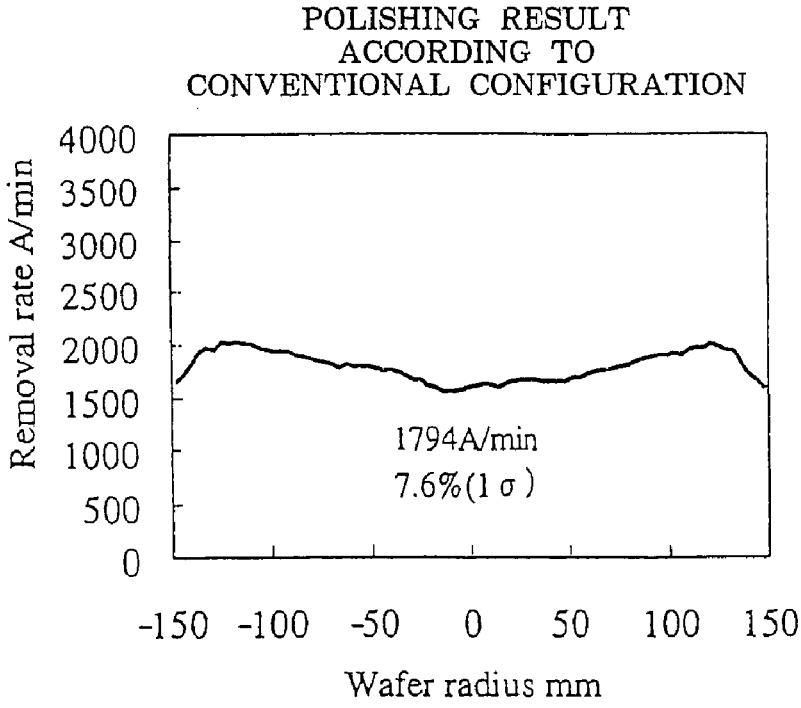

In the case of the conventional configuration showing a polishing result in FIG. 13B, since supply of slurry is conducted at only one point separated from the polishing pad center by 50 mm, a small amount of slurry such as 100 ml/min does not run around to a whole face of the wafer completely. This is thought due to that slurry is supplied via grooves formed on the pad surface, but because the slurry is not present in the grooves of the pad sufficiently as if it overflows from the grooves, slurry spread in the grooves in a pressing manner is not lift up to the polishing pad surface. Therefore, lack in slurry occurs as a whole, so that the polishing rate becomes low such as 1794 A/min. The polished shape becomes a center slow state where the rate at the central portion of the wafer is low, and in-plane evenness of polishing deteriorates to 7.6%.

On the other hand, in the wafer polishing method according to the present invention showing a polishing result in FIG. 13A, the polishing rate is very high such as 2897 A/min and in-plane evenness of polishing becomes excellent such as 2.9%. This is because slurry flows down on the slurry supplying member to be selectively supplied to only the surface portion of the polishing pad instead of the grooves formed on the polishing pad so that almost all of slurry supplied contributes to polishing.

From the above, the present invention has a capability of supplying even an extremely small amount of slurry to a polishing pad surface evenly and can keep the polishing rate high. The present invention is effective for achieving in-plane evenness of polishing. From this, the present invention can suppress consumption of slurry to the minimum to realize cost reduction during running for mass production.

As described above, in the polishing method and the polishing apparatus according to the embodiment, polishing by-product that has been generated during polishing together with slurry that has contributed to polishing can be dropped into the respective groove elements 23*a*, 23*b*, and 23*c* efficiently according to relative movement between the both of the wafer W and the polishing pad 19 rotating respectively.

Since the plurality of groove elements 23*a*, 23*b*, and 23*c* serving to exhaust polishing by-product together with slurry that has contributed to polishing to the outside of the polishing pad 19 communicate from the surface portion of the polishing pad 19 to the edge portion thereof and the inner faces of the grooves have been subjected to water-repellant treatment, polishing by-product accumulating in the groove elements 23*a*, 23*b*, and 23*c* together with slurry that has contributed to polishing can be removed from the edge portion outside the polishing pad 19 efficiently by jetting pure water from the groove washing nozzle 24 or the groove washing high-pressure water nozzle 25 along the respective groove elements 23*a*, 23*b*, and 23*c* while rotating the polishing pad 19 during a polishing processing.

Supply of slurry to the polishing face on the polishing pad 19 is performed by causing the slurry to flow down along the slurry supplying member 15*a*, so that even a small amount of slurry can be spread on the polishing face evenly and thinly due to interfacial tension acting between the polishing face of the polishing pad 19 and the slurry supplying member 15*a*.

Wafers W can be always chemically and mechanically polished on the polishing face that is constantly supplied with fresh slurry evenly and thinly. As a result, even polished shape to a wafer W can be secured and scratches due to polishing by-product can be reduced, and cost reduction during running for mass production can be realized by suppressing consumption of slurry to the minimum.

Since the distal end of the slurry supplying member 15*a* is put in non-contact with the bottom portions of the respective groove elements 23*a*, 23*b*, and 23*c*, fresh slurry is prevented from being supplied into the respective groove elements and polishing by-product accumulating in the grooves can be prevented from climbing on the polishing face.

Incidentally, the present invention can be modified variously without departing from the spirit and scope of the invention and such modifications are also included in the present invention, of course.

INDUSTRIAL APPLICABILITY

As described above, the polishing method and the polishing apparatus according to the present invention have the best application to a polishing method and a polishing apparatus of a wafer that secure an even polished shape of a wafer as Chemical Mechanical Polishing, remove slurry that has contributed to polishing and contains polishing by-product outside a polishing pad efficiently to reduce scratches due to the polishing by-product, and suppress consumption of slurry to the minimum to realize cost reduction during running for mass production.

What is claimed is:

1. A polishing method where a polishing pad is supplied with slurry and polishing is performed by relative movement between the polishing pad and a wafer comprising the steps of:

extending a slurry supply member having a distal end with a cross section dimension in an intersecting direction with respect to a moving direction of the polishing pad;

calculating a slurry droplet diameter at the distal end of said slurry supply member due to surface tension considering the surface tension of the slurry, temperature, and the cross section dimension of the slurry supply member;

moving the slurry supply member approaching the polishing pad to within a distance greater than zero but less than the slurry droplet diameter calculated in said step of calculating a slurry droplet diameter so that no slurry droplet is formed between the distal end of said slurry supply member and the polishing pad;

supplying slurry flow by interfacial action of the slurry supply member; and moving the polishing pad relative to the slurry supply member, whereby slurry is applied and spread on the polishing pad evenly and thinly.

2. The polishing method according to claim 1, wherein:

the slurry supply member comprises capillary action means for spreading slurry on said wafer polishing pad evenly due to interfacial action between the polishing pad and the capillary action means.

3. The polishing method according to claim 1, wherein:

the slurry supply member comprises a plurality of wire, brush, or bristle members, whereby slurry is guided along the exterior of the plurality of wire, brush, or bristle members.

4. The polishing method according to claim 1, wherein:

the polishing pad has grooves.

5. The polishing method according to claim 4, further comprising the step of:

washing away polishing by product dropped in the grooves after polishing.

6. A wafer polishing apparatus comprising:

a wafer polishing pad;

a slurry supplying pipe placed in an intersecting direction with said wafer polishing pad;

capillary action means, associated with said slurry supplying pipe, for spreading slurry on said wafer polishing pad evenly due to interfacial action between said polishing pad and said capillary action means; and means, attached to said slurry supplying pipe, for causing a distal end of said capillary action means to approach said wafer polishing pad to within a distance greater than zero but less than a calculated slurry droplet diameter where a droplet of slurry is not formed at the distal end of said capillary action means due to the positioning of the distal end of said capillary action means to within the distance greater than zero but less than a calculated slurry droplet diameter so that before the droplet of slurry is formed on the distal end of said slurry capillary action means the slurry contacts said wafer polishing pad, whereby slurry is applied and spread on only a surface of said wafer polishing pad evenly and thinly.

7. A wafer polishing apparatus as in claim 6 wherein:

said capillary action means comprises a plurality of wire members, whereby slurry is guided along the exterior of the plurality of wire members.

8. A wafer polishing apparatus as in claim 6 wherein:

said capillary action means comprises a plurality of brush members, whereby slurry is guided along the exterior of the plurality of brush members.

9. A water polishing apparatus as in claim 6 wherein:

said polishing pad comprises grooves on a surface.

10. A wafer polishing apparatus as in claim 9 wherein:

means for supplying pure water along the grooves.

11. A wafer polishing apparatus as in claim 9 further comprising:

water repellent treatment within the grooves.

12. A wafer polishing apparatus comprising:

a wafer polishing pad;

a plurality of grooves formed in said wafer polishing pad;

a slurry supplying pipe placed in an intersecting direction with said wafer polishing pad;

wire members attached to said slurry supplying pipe, wherein slurry is guided along the exterior of said wire members so as to provide slurry to said wafer polishing pad by capillary action spreading slurry on said wafer polishing pad evenly and thinly;

means, attached to said slurry supplying pipe, for causing said wire members to approach said wafer polishing pad closer than a distance of a diameter of a droplet of slurry formed at a distal end of said wire member due to capillary action greater than zero;

a groove washing nozzle positioned adjacent the plurality of grooves, whereby polishing by products and used slurry are removed;

whereby slurry is applied and spread on only the surface of said wafer polishing pad evenly and thinly but not in said plurality of grooves and polishing by products and used slurry accumulating in said plurality of grooves are prevented from damaging a wafer being polished.

13. A wafer polishing apparatus as in claim 12 wherein:

said wire members do not contact the bottom of any of said plurality of grooves.

* * * * *